US012680144B2

(12) United States Patent
Fürst et al.

(10) Patent No.: US 12,680,144 B2
(45) Date of Patent: Jul. 14, 2026

(54) ENERGY-EFFICIENT PRODUCTION OF A FERRITIC HOT-ROLLED STRIP IN AN INTEGRATED CASTING-ROLLING PLANT

(71) Applicant: Primetals Technologies Austria GmbH, Linz (AT)

(72) Inventors: Heinz Fürst, Gallneukirchen (AT); Simon Grosseiber, Leonding (AT); Thomas Lengauer, Weißkirchen a.d. Traun (AT); Michael Zahedi, St. Marien (AT)

(73) Assignee: Primetals Technologies Austria GmbH (AT)

( * ) Notice: Subject to any disclaimer, the term of this patent is extended or adjusted under 35 U.S.C. 154(b) by 0 days.

(21) Appl. No.: 18/599,283

(22) Filed: Mar. 8, 2024

(65) Prior Publication Data

US 2024/0209471 A1 Jun. 27, 2024

Related U.S. Application Data

(62) Division of application No. 17/550,028, filed on Dec. 14, 2021, now Pat. No. 11,987,859.

(30) Foreign Application Priority Data

Dec. 15, 2020 (EP) ..... 20214219

(51) Int. Cl.
*C21D 9/60* (2006.01)
*C21D 1/42* (2006.01)
(Continued)

(52) U.S. Cl.
CPC ..... *C21D 9/60* (2013.01); *C21D 1/42* (2013.01); *C21D 8/02* (2013.01); *C21D 8/0226* (2013.01); *C23G 3/023* (2013.01)

(58) Field of Classification Search
CPC ..... C21D 9/60; C21D 1/42; C21D 8/0205; C21D 8/0226; C23G 3/023; B21B 45/08;
(Continued)

(56) References Cited

U.S. PATENT DOCUMENTS 4,994,118 A 2/1991 Pircher et al. ..... 148/2
6,290,787 B1 9/2001 Babbit et al. ..... 148/541
(Continued)

FOREIGN PATENT DOCUMENTS

CN 109321818 A 2/2019
CN 109482646 A 3/2019
(Continued)

OTHER PUBLICATIONS

Machine translation of EP3025799A1 (Year: 2016).*
(Continued)

*Primary Examiner* — Sally A Merkling
*Assistant Examiner* — Nazmun Nahar Shams
(74) *Attorney, Agent, or Firm* — OSTROLENK FABER LLP

(57) ABSTRACT

Energy-efficient production of a ferritic hot-rolled strip (6) in an integrated casting-rolling plant (1), which modifies the known processes for producing a ferritic hot-rolled strip (6) in an integrated casting-rolling plant (1) so that the ferritic hot-rolled strip (6) can be produced significantly more energy-efficiently but nevertheless has good metallurgical properties and a good surface quality.

3 Claims, 2 Drawing Sheets

Figure 1:
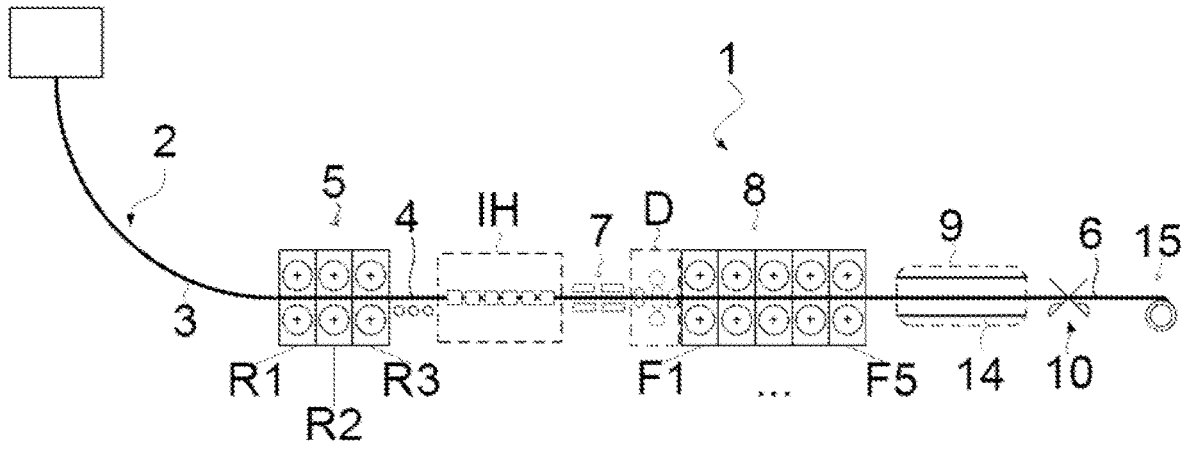

(51) Int. Cl.

| | |
|---|---|
| ***C21D 8/02*** | (2006.01) |
| ***C21D 8/0221*** | (2026.01) |
| ***C23G 3/02*** | (2006.01) |

(58) Field of Classification Search
CPC ... B21B 2201/04; B21B 45/004; B21B 45/06; B21B 1/463; B21B 1/26; B21B 2201/06
USPC ..... 148/541
See application file for complete search history.

(56) References Cited

U.S. PATENT DOCUMENTS

| | | | | |
|---|---|---|---|---|
| 6,498,324 | B2 | 12/2002 | Yamamoto et al. | 219/661 |
| 6,527,882 | B1 * | 3/2003 | Wehage | B21B 1/463 148/541 |
| 7,087,869 | B2 | 8/2006 | Eguchi et al. | 219/676 |
| 7,958,609 | B2 | 6/2011 | Gaydoul | 29/81.08 |
| 9,308,563 | B2 * | 4/2016 | Ota | B21B 37/76 |
| 10,695,810 | B2 | 6/2020 | Lu et al. | |
| 2005/0155740 | A1 | 7/2005 | Arvedi | 164/452 |
| 2012/0067095 | A1 | 3/2012 | Hohenbichler et al. | 72/11.3 |
| 2014/0096578 | A1 | 4/2014 | Eckerstorfer et al. | 72/40 |

FOREIGN PATENT DOCUMENTS

| | | | | |
|---|---|---|---|---|
| CN | 110394363 | A | 11/2019 | |
| DE | 19758108 | C1 | 1/1999 | |
| EP | 3025799 | A1 * | 6/2016 | B21B 45/004 |
| EP | 3769862 | A1 | 1/2021 | |
| WO | WO 2016/083439 | A1 | 6/2016 | |
| WO | WO 2021/013488 | A1 | 1/2021 | |

OTHER PUBLICATIONS

Roman Winkler [WO2018082966A1] (machine translation) (Year: 2018).*

Office Action dated Oct. 27, 2023 for corresponding European Patent Application No. 20214219.6.

Valery Rudnev et al. "Induction Surface Hardening of Steels", ASM Handbook, vol. 4A, Steel Heat Treating Fundamentals and Processes. 2013, 438-461, (Year: 2013).

Seidel Jurgen [EP3025799A1] (Machine Translation) (Year: 2016).

European Search Report mailed Jun. 14, 2021 in corresponding European Patent Application No. 20214219.6.

Notification to Grant Patent Right for Invention dated Jan. 30, 2026, issued in corresponding Chinese Patent Application No. 202111532335.4 and its English translation.

* cited by examiner

ENERGY-EFFICIENT PRODUCTION OF A FERRITIC HOT-ROLLED STRIP IN AN INTEGRATED CASTING-ROLLING PLANT

CROSS REFERENCE TO RELATED APPLICATIONS

The present application is a divisional under 37 C.F.R. § 1.53(b) of prior U.S. patent application Ser. No. 17/550,028, filed Dec. 14, 2021, in the name of Heinz FγRST, Simon GROSSEIBER, Thomas LENGAUER, and Michael ZAHEDI and entitled ENERGY-EFFICIENT PRODUCTION OF A FERRITIC HOT-ROLLED STRIP IN AN INTEGRATED CASTING-ROLLING PLANT, which claims priority of European Patent Application No. 20214219.6 filed Dec. 15, 2020, the contents of which are incorporated by reference herein.

FIELD OF THE INVENTION

The present invention relates to the technical field of steel metallurgy, specifically the particularly energy-efficient production of a ferritic hot-rolled strip in an integrated casting-rolling plant.

The invention firstly relates to a process for producing a ferritic hot-rolled strip in an integrated casting-rolling plant, comprising the steps: continuous casting of a liquid steel to give a strip having a slab or thin slab cross section in a continuous casting plant; prerolling of the strip to give an intermediate strip in a multipart roughing stand; descaling of the broad sides of the heated intermediate strip in a descaling apparatus; final rolling of the descaled intermediate strip to give the hot-rolled strip in a multipart finishing stand, where at least the last rolling pass in the finishing stand takes place in the ferritic temperature range of the steel; setting of the hot-rolled strip to coiler temperature; and winding-up of the hot-rolled strip in a coiler.

Secondly, the invention relates to an integrated casting-rolling plant which is particularly suitable for producing a ferritic hot-rolled strip, comprising: a continuous casting plant for continuously casting a liquid steel to give a strip having a slab or thin slab cross section; a multipart roughing stand for prerolling the strip to give an intermediate strip; a descaling apparatus for descaling the broad sides of the heated intermediate strip; a multipart finishing stand for final rolling of the descaled intermediate strip to give the hot-rolled strip, where at least the last rolling pass in the finishing stand takes place in the ferritic temperature range of the steel; a cooling section for bringing the hot-rolled strip to coiler temperature; and a coiler for winding-up the hot-rolled strip.

PRIOR ART

The application WO 2021/013488 A1 discloses production of a ferritic hot-rolled strip in an integrated casting-rolling plant by the steps of continuous casting of a strip having a slab or thin slab cross section, prerolling of the strip to give an intermediate strip in a multipart roughing stand, heating of the intermediate strip to an average temperature of ≥1070° C., descaling of the heated intermediate strip, final rolling of the descaled intermediate strip to give a hot-rolled strip in a multipart finishing stand, where at least the last rolling pass in the finishing stand takes place in the ferritic temperature range, cooling of the hot-rolled strip to coiler temperature and winding-up of the hot-rolled strip in a coiler.

Although the ferritic hot-rolled strip produced has good metallurgical properties and a good surface quality, the process is energy-intensive since the average temperature of the intermediate strip is firstly brought to a high temperature of ≥1070° C., the intermediate strip is then descaled and the average temperature of the intermediate strip is subsequently brought down to <900° C. in an intensive cooling step. How the process can be altered so that the hot-rolled strip has equally good metallurgical properties and a good surface quality but the energy consumption is greatly reduced is not apparent from the document.

BRIEF DESCRIPTION OF THE INVENTION

It is an object of the invention to modify a process for producing a ferritic hot-rolled strip in an integrated casting-rolling plant in such a way that the ferritic hot-rolled strip can be produced in a significantly more energy-efficient way but it nevertheless has good metallurgical properties and a good surface quality. In addition, an integrated casting-rolling plant which is particularly suitable for this purpose is to be provided.

The process-related aspect of this object is achieved by a process as claimed. Advantageous further developments are subject matter of the dependent claims.

Specifically, the object is achieved by a process for producing a ferritic hot-rolled strip in an integrated casting-rolling plant, comprising the steps: continuous casting of a liquid steel to give a strip having a slab or thin slab cross section in a continuous casting plant; prerolling of the strip to give an intermediate strip in a multipart roughing stand; heating of the broad sides of the intermediate strip by one or preferably more inductive surface heating modules to a surface temperature of ≥1000° C., preferably ≥1050° C., where the surface heating module is operated using an alternating current having a first frequency f1 and the first frequency f1 obeys: f1≥20 kHz, preferably f1≥50 kHz, particularly preferably f1≥100 kHz; descaling of the broad sides of the heated intermediate strip in a descaling apparatus; final rolling of the descaled intermediate strip to give the hot-rolled strip in a multipart finishing stand, where the descaled intermediate strip after descaling and without further cooling enters a first set of the finishing stand with an average temperature of 775-900° C. and at least the last rolling pass in the finishing stand takes place in the ferritic temperature range of the steel; setting of the hot-rolled strip to coiler temperature; and winding-up of the hot-rolled strip in a coiler.

The expression average temperature (also referred to as averaged temperature) is intended to refer to any temperature which corresponds to the average temperature of the different layers of the intermediate strip in the thickness direction. It is thus generally not the temperature of the intermediate strip in the middle (i.e. in the central region) of the intermediate strip in the thickness direction.

When setting the hot-rolled strip to coiler temperature, the hot-rolled strip is typically thermally insulated in the region between the last set of the finishing stand and the coiler, so that the average temperature of the hot-rolled strip decreases only slightly. As a result, a high coiler temperature is attained without the hot-rolled strip having to be actively heated up or reheated. As an alternative, the hot-rolled strip can either be actively cooled or even heated up using a heating device. A combination of a heating device after the last set of the finishing stand and a cooling section for actively cooling the hot-rolled strip before winding-up is also conceivable and advantageous for particular grades of steel.

According to the invention, the intermediate strip is heated by at least one surface heating module to a surface temperature of ≥1000° C. Since the surface heating module or modules is/are operated using an alternating current having a first frequency f1 and the first frequency f1 obeys: f1≥20 kHz, only the layers of the broad sides close to the surface are heated, with the temperature of the core of the intermediate strip changing only slightly. In other words, the surface temperature on the broad sides of the intermediate strip is increased significantly more greatly than the average temperature of the intermediate strip by the surface heating module or modules. The broad sides of the hot intermediate strip are subsequently descaled, e.g. in a pinch roll descaler. The descaled intermediate strip goes, directly after descaling, i.e. without further cooling, with an average temperature of 775-900° C. into the first set of the finishing stand and is subjected to final rolling in the multipart finishing stand to give the hot-rolled strip. In order to produce a ferritic hot-rolled strip directly in the integrated casting-rolling plant, at least the last rolling pass in the finishing stand takes place in the ferritic temperature range of the steel. The temperature of the ferritic hot-rolled strip is subsequently brought to coiler temperature and wound up in the coiler to give coils.

There are therefore a number of differences from the prior art: firstly, heating of only the layers of the broad sides close to the surface and not uniformly all layers of the intermediate strip by the inductive surface heating modules. Since the broad sides have a surface temperature of ≥1000° C. before descaling, descaling occurs very thoroughly, leading to a high surface quality of the hot-rolled strip. Secondly, the descaled intermediate strip enters the first set of the finishing stand directly with an average temperature of 775-900° C. without being cooled especially by an intensive cooling step after descaling. Accordingly, energy is saved since only the layers of the broad sides of the intermediate strip close to the surface and not the entire intermediate strip have to be heated to a comparatively high temperature before descaling. Secondly, the average temperature of the intermediate strip before descaling can be very low (for example in the range from 875 to 990° C.), which in turn is very advantageous for the energy efficiency of the production process.

The ratio of the thickness s of the intermediate strip to the penetration depth d into the heated intermediate strip is preferably: s/d≤6, preferably s/d≤10, particularly preferably s/d≤14 and very particularly preferably s/d≤16. The term penetration depth 6 (also referred to as current penetration) refers to a region in the intermediate strip in which the current density has dropped to 37% relative to the outer edge of the broad sides. In the region of the penetration depth, 86% of the induced energy is converted into heat while only 14% heats the regions deeper down. Specifically, this means that, for example at an intermediate strip thickness of 24 mm, the penetration depth d at s/d≤6 must be not more than 4 mm. The penetration depth can be estimated by the formula $$\delta = \frac{1}{\sqrt{\pi \mu_0 \mu_r f \kappa}}$$

where $\mu_0$ is the magnetic field constant, $\mu_r$ is the relative electromagnetic permeability of the steel, f is the frequency of the alternating current and κ is the electrical conductivity. All parameters mentioned should be in SI units. Since K in particular but also $\mu_r$ are strongly temperature-dependent, these values at the prevailing temperature during heating have to be used.

An inductive surface heating module preferably heats the intermediate strip by transverse field heating. However, it is also possible for heating to be effected by longitudinal field heating. In the case of transverse field heating, it is advantageous for a first inductor to heat the upper broad side of the intermediate strip and a second inductor opposite the first inductor in the vertical direction to heat the lower broad side of the intermediate strip.

It is advantageous to set the coupling gap, i.e. the vertical distance between an upper inductor and an upper broad side of the intermediate strip, as a function of the intermediate strip thickness or to keep it constant. Setting is effected, for example, by a linear motor.

To achieve thorough descaling of the intermediate strip in the width direction, it is advantageous for each broad side of the intermediate strip to be descaled by at least one row of in each case a plurality of spray nozzles. The spray nozzles of a row are either stationary or arranged on rotating rotors.

A good descaling effect is achieved when descaling is effected by a liquid descaling agent, for example water, where the descaling agent has a pressure in the range 450 bar>p>100 bar at the spray nozzles.

In order to keep the descaling agent in the descaling apparatus, it is advantageous for a pair of pinch rolls next to the intermediate strip to be arranged in the flow direction of the material before the first row and after the last row of spray nozzles.

Depending on the grade of steel, method of operation (continuous, semicontinuous or batch operation) or the casting rate, it can be advantageous to increase the average temperature of the intermediate strip using a plurality of inductive volume-heating modules in an induction furnace before the heating of the broad sides. The average temperature of the intermediate strip is increased to about the same degree as the surface temperature by the volume-heating module or modules. It is advantageous here for the inductive surface heating modules to be operated at a first frequency f1 and the inductive volume-heating modules to be operated at a second frequency f2, where: f1>f2, preferably f1≥2*f2, particularly preferably f1≥5*f2. The volume-heating modules preferably heat the intermediate strip by longitudinal field heating. However, it is likewise possible for heating to occur by transverse field heating.

To set the entry temperature of the descaled intermediate strip into the finishing stand, the surface temperature $T_{act}$ of the partially finished intermediate strip between the first finishing set and the second finishing set or between the second finishing set and the third finishing set of the finishing stand is advantageously measured by a pyrometer, a temperature regulator advantageously transmits an actuation variable as a function of an intended surface temperature $T_{int}$ and taking into account $T_{act}$ to at least one, preferably a plurality of, inductive volume-heating modules and the volume-heating modules advantageously heat the intermediate strip to such a degree that the measured surface temperature $T_{act}$ corresponds closely to the intended surface temperature $T_{int}$.

This process is based on the recognition that the temperature of the heated and descaled intermediate strip can be measured only inaccurately before the finishing stand and the temperature measurement in one of the intermediate set regions of the first three sets is significantly more accurate.

The inductive volume-heating modules are regulated as a function of the measured actual temperature and taking into account the intended temperature by a temperature regulator in such a way that the actual temperature corresponds very closely to the intended temperature.

The apparatus-related aspect of the technical object is achieved by an integrated casting-rolling plant as claimed. Advantageous further developments are subject matter of the dependent claims.

Specifically, the object is achieved by an integrated casting-rolling plant for producing a ferritic hot-rolled strip, in particular for carrying out the process as claimed, comprising:

- a continuous casting plant for continuously casting a liquid steel to give a strip having a slab or thin slab cross section;
- a multipart roughing stand for prerolling the strip to give an intermediate strip;
- one or more inductive surface heating modules for heating the broad sides of the intermediate strip to a surface temperature of ≥1000° C., where a surface heating module is heated by an alternating current having a first frequency f1 and the first frequency f1 obeys: f1≥20 kHz, preferably f1≥50 kHz, particularly preferably f1≥100 kHz;
- a descaling apparatus for descaling the broad sides of the heated intermediate strip;
- a multipart finishing stand for final rolling of the descaled intermediate strip to give the hot-rolled strip, where the descaled intermediate strip after descaling and without further cooling enters a first set of the finishing stand with an average temperature of 775-900° C. and at least the last rolling pass in the finishing stand takes place in the ferritic temperature range of the steel;
- a cooling section for bringing the hot-rolled strip to coiler temperature; and
- a coiler for winding up the hot-rolled strip.

An induction furnace having a plurality of induction volume-heating modules is preferably arranged in the flow direction of the material between the roughing stand and the inductive surface heating modules, where the induction furnace increases the average temperature of the intermediate strip.

In addition, a pyrometer for measuring the surface temperature $T_{act}$ of the partially finished intermediate strip is preferably arranged between the first finishing set and the second finishing set or between the second finishing set and the third finishing set of the finishing stand, the pyrometer is preferably connected so as to be able to transmit a signal to a temperature regulator and the temperature regulator is connected so as to be able to transmit a signal to at least one inductive volume-heating module, the temperature regulator can preferably transmit an actuating variable as a function of an intended surface temperature $T_{int}$ and taking into account $T_{act}$ to at least one inductive volume-heating module, where the volume-heating modules can heat the intermediate strip to such a degree that the measured surface temperature $T_{act}$ corresponds closely to the intended surface temperature $T_{int}$.

BRIEF DESCRIPTION OF THE DRAWING(S)

Figure 2:
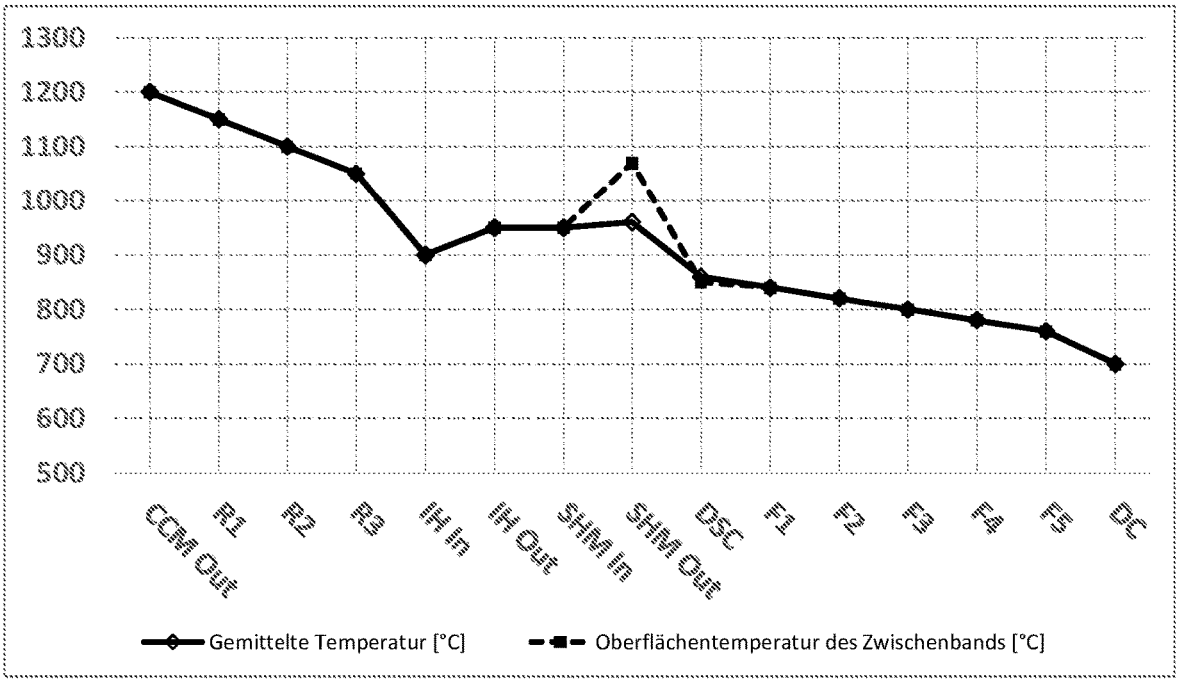
Figure 3:
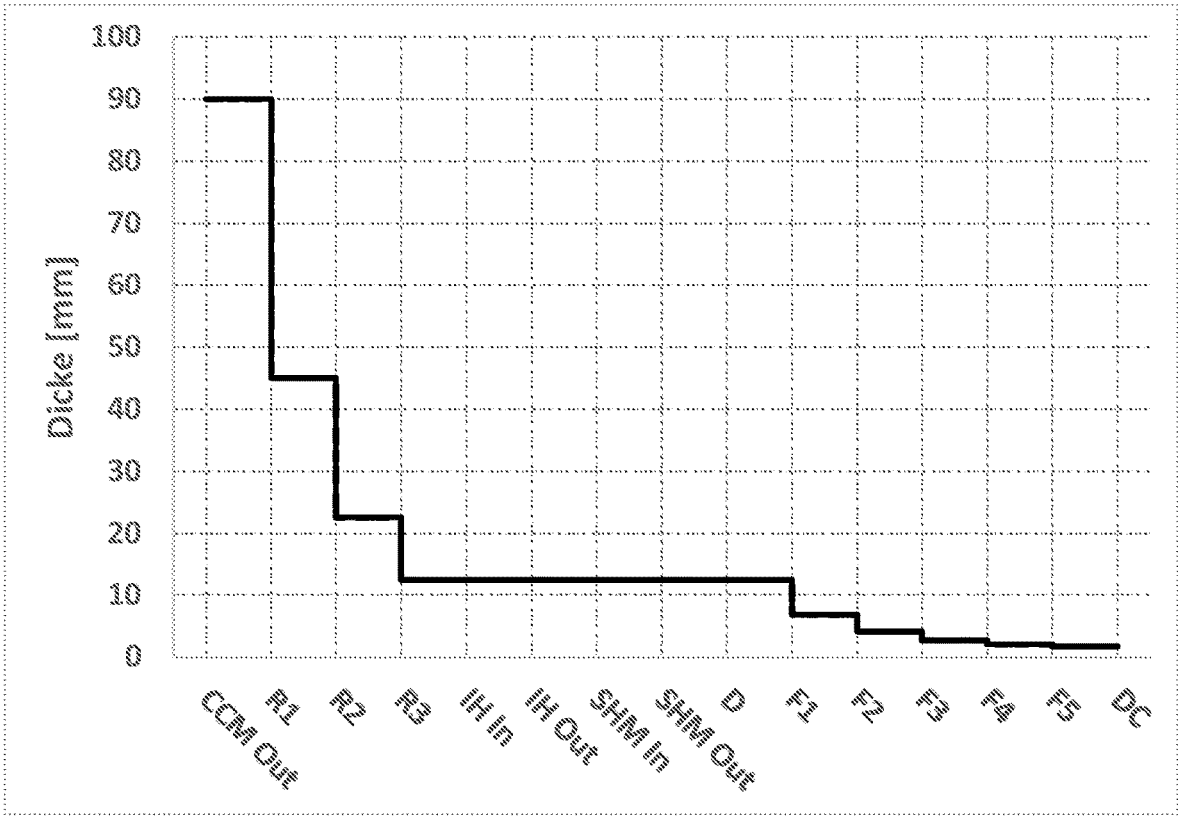

The above-described properties, features and advantages of the present invention and the way in which these are achieved will become clearer and more easily understood in connection with the following description of a working example which is explained in more detail in conjunction with the drawings. The drawings show:

FIG. 1 a schematic depiction of an integrated casting-rolling plant according to the invention for carrying out the process of the invention, FIG. 2 a temperature profile of the process of the invention, and FIG. 3 a thickness profile for the process of the invention.

DESCRIPTION OF THE EMBODIMENTS

In the integrated casting-rolling plant 1 of FIG. 1, liquid steel having the following chemical composition,

TABLE 1

Chemical composition of the steel

| VVVElement | % by weight |
|---|---|
| C | <0.004 |
| Mn | <0.2 |
| P | <0.01 |
| Ti + Nb | 0.03 |
| Fe | Balance |

is continuously cast in the continuous casting plant 2 to give a strip 3 having a slab cross section. The strip 3 leaves the continuous casting plant 2 with a thickness of 90 mm and at a speed of 6 m/min. The partially solidified strip 3 is preferably subjected to a soft core reduction or a liquid core reduction (LCR) in the arc-shaped course of the strip. This reduces the thickness of the strip and improves the internal quality thereof. The strip 3 goes uncut into the three-stage finishing stand 5 and is reduced there to an intermediate strip 4 having a thickness of 12.4 mm. The last rolling pass in the set R3 of the finishing stand 5 is carried out in the austenitic temperature range at a final rolling temperature of 1050° C. The average temperature of the intermediate strip 4 is subsequently increased from 900° C. to 950° C. by six volume-heating modules of an induction furnace IH. Subsequently, the surface temperature on the broad sides of the heated intermediate strip 4 is brought to 1070° C. by two surface heating modules 7. The surface heating modules are operated at a frequency of 50 kHz and heat the intermediate strip by transverse field heating. The heating of the broad sides increases the average temperature of the intermediate strip to 960° C. After heating, the broad sides of the intermediate strip 4 are descaled in a descaling apparatus D, specifically a pinch roll descaler. In the step, the average temperature of the intermediate strip decreases to 850° C. After descaling, the descaled intermediate strip 3 enters the five-stage finishing stand 8 and is there subjected to final rolling in 5 rolling passes to give a hot-rolled strip 6 having a thickness of 1.7 mm. Since the last rolling pass in the set F5 takes place at an average temperature of 760° C., a hot-rolled strip having a ferritic microstructure is present at the latest after the last rolling pass. The last three rolling passes in the rolling sets F3, F4 and F5 (particularly preferably all rolling passes) of the finishing stand 8 are preferably carried out using roller gap lubrication. Here, a mineral oil is sprayed in each case between the working rollers of the finishing set and the material being rolled so that the coefficient of friction in the roller gap is reduced to a value μ of <0.15. This prevents shear bands, which lead to development of an undesirable GOSS texture, being formed in the finished hot-rolled strip. The hot-rolled strip 6 leaves the finishing stand 8 with a surface temperature of 760° C. In order to achieve a high coiling temperature, the hot-rolled strip is not actively cooled in the region of the cooling section 9 shown as a broken line but is instead thermally insulated by insulation panels 14. The coiling temperature is 700° C. Shortly before the coil has attained its target weight, the continuous hot-rolled strip is parted transversely by the cutter 10 and the winding-up is continued on a further coiling device (not shown in FIG. 1), where the ferrite in the hot-rolled strip 6 at least partly forms a {1 1 1} texture. The average temperatures in the individual apparatuses of the integrated casting-rolling plant 1 can be seen either from FIG. 2 or the following table:

TABLE 2

Temperature profile

| | Temperature [° C.] |
|---|---|
| CCM Out | 1200 |
| R1 | 1150 |
| R2 | 1100 |
| R3 | 1050 |
| IH In | 900 |
| IH Out | 950 |
| SHM In | 950 |
| SHM Out | 1070 |
| D | 850 |
| F1 | 840 |
| F2 | 820 |
| F3 | 800 |
| F4 | 780 |
| F5 | 760 |
| DC | 700 |

The degrees of reduction in the individual sets R1 . . . R3 and F1 . . . F5 and also the thicknesses of the thin slab 2, the intermediate strip 4 and the hot-rolled strip 6 can be derived either from FIG. 3 or the following table:

TABLE 3

Thicknesses and degrees of reduction

| | Thickness [mm] | Degree of reduction [%] |
|---|---|---|
| CCM Out | 90.0 | |
| R1 In | 90.0 | 50 |
| R1 Out | 45.0 | |
| R2 In | 45.0 | 50 |
| R2 Out | 22.5 | |
| R3 In | 22.5 | 45 |
| R3 Out | 12.4 | |
| IH In | 12.4 | |
| IH Out | 12.4 | |
| SHM In | 12.4 | |
| SHM Out | 12.4 | |
| D | 12.4 | |
| F1 In | 12.4 | 45 |
| F1 Out | 6.8 | |
| F2 In | 6.8 | 40 |
| F2 Out | 4.1 | |
| F3 In | 4.1 | 35 |
| F3 Out | 2.7 | |
| F4 In | 2.7 | 25 |
| F4 Out | 2.0 | |
| F5 In | 2.0 | 15 |
| F5 Out | 1.7 | |
| DC | 1.7 | |

In order to ensure the continuous operation of the integrated casting-rolling plant 1, the hot-rolled strip 6 is cut immediately before the coiling devices and alternatively wound up by at least two coiling devices DC.

As a result of the use of the process of the invention in the integrated casting-rolling plant 1, the coiled hot-rolled strip 6 has good deep drawability without the hot-rolled strip 6 having to be additionally cold-rolled or heat treated after the hot rolling.

Although the invention has been illustrated and described in detail by the preferred working examples, the invention is not restricted by the examples disclosed and other variations can be derived therefrom by a person skilled in the art, without going outside the scope of protection of the invention.

LIST OF REFERENCE SYMBOLS

1 Integrated casting-rolling plant
2 Continuous casting plant
3 Strip
4 Intermediate strip
5 Roughing stand
6 Hot-rolled strip or finished strip
7 Surface heating module
8 Finishing stand
9 Cooling section
10 Cutter
14 Insulation panel
15, DC Coiler
D Descaling apparatus
F1 . . . F5 First to fifth set of the finishing stand
IH Induction furnace
In Entry of an apparatus
Out Exit of an apparatus
R1 . . . R3 First to third set of the roughing stand
$T_{act}$ Actual surface temperature
$T_{int}$ Intended surface temperature

What is claimed is:

1. An integrated casting-rolling plant for producing a ferritic hot-rolled strip by carrying out a process comprising:

a continuous caster for continuously casting a liquid steel to give a first strip having a slab or thin slab cross section;

a multipart roughing stand for prerolling the first strip to give an intermediate strip;

at least one inductive surface heating module being configured for heating broad sides of the intermediate strip to a surface temperature of ≥1000° C., wherein the at least one surface heating module is heated by an alternating current having a first frequency f1;

a descaling apparatus configured for descaling the broad sides of the heated intermediate strip;

a multipart finishing stand configured for final rolling of the descaled intermediate strip to give a hot-rolled strip, wherein the descaled intermediate strip after descaling and without further cooling enters a first set of the finishing stand with an average temperature of 775-900° C. and at least a last rolling pass in the finishing stand takes place in a ferritic temperature range of ferritic steel;

a cooling section configured for bringing the hot-rolled strip to coiler temperature, the cooling section having insulation panels between which the hot-rolled strip passes to thermally insulate the hot-rolled strip;

a cutter downstream of the cooling section; and a coiler downstream of the cutter and configured for winding up the hot-rolled strip.

2. The integrated casting-rolling plant as claimed in claim 1, wherein an induction furnace (IH) having a plurality of inductive volume-heating modules is arranged in the flow direction of the material between the multipart roughing stand and the at least one inductive surface heating module wherein the induction furnace (IH) increases temperature of the intermediate strip.

3. The integrated casting-rolling plant as claimed in claim 1, wherein a pyrometer for measuring a surface temperature Tact of the partially finished intermediate strip is arranged between the first stand of the finishing mill and a second stand of the finishing mill or between the second stand and a third stand of the finishing mill, the pyrometer is connected so as to be able to transmit a signal to a temperature regulator and the temperature regulator is connected so as to be able to transmit a signal to the at least one inductive volume-heating module, the temperature regulator can transmit an actuating variable as a function of an intended surface temperature Tint and taking into account the surface temperature Tact to at least one inductive volume-heating module, wherein the volume-heating modules can heat the intermediate strip to such a degree that the surface temperature Tact corresponds closely to the intended surface temperature Tint.

* * * * *